US008297533B2

(12) United States Patent
Dunn et al.

(10) Patent No.: US 8,297,533 B2
(45) Date of Patent: Oct. 30, 2012

(54) ROTARY STREAM SPRINKLER WITH ADJUSTABLE ARC ORIFICE PLATE

(75) Inventors: Richard M. Dunn, Carlsbad, CA (US); Glendale Grizzle, Murrieta, CA (US)

(73) Assignee: Hunter Industries, Inc., San Marcos, CA (US)

( * ) Notice: Subject to any disclaimer, the term of this patent is extended or adjusted under 35 U.S.C. 154(b) by 480 days.

(21) Appl. No.: 12/577,002

(22) Filed: Oct. 9, 2009

(65) Prior Publication Data

US 2011/0084151 A1 Apr. 14, 2011

(51) Int. Cl.

| | |
|---|---|
| ***B05B 15/10*** | (2006.01) |
| ***B05B 3/02*** | (2006.01) |
| ***B05B 3/06*** | (2006.01) |
| ***F23D 11/04*** | (2006.01) |

(52) U.S. Cl. ..... 239/205; 239/222.11; 239/222.17; 239/257

(58) Field of Classification Search ..... 239/200–206, 239/461, 500, 505, 581.1, 210, 222.17, 263.3, 239/222.11, 222.13, 256, 257, DIG. 1
See application file for complete search history.

(56) References Cited

U.S. PATENT DOCUMENTS

| | | | | |
|---|---|---|---|---|
| 2,546,574 | A * | 3/1951 | Wilcox, Jr. | 239/204 |
| 4,898,332 | A * | 2/1990 | Hunter et al. | 239/240 |
| 5,226,602 | A * | 7/1993 | Cochran et al. | 239/583 |
| 6,019,295 | A * | 2/2000 | McKenzie | 239/451 |
| 7,322,533 | B2 * | 1/2008 | Grizzle | 239/204 |
| 2008/0169363 | A1 * | 7/2008 | Walker | 239/457 |

* cited by examiner

*Primary Examiner* — Len Tran
*Assistant Examiner* — Justin Jonaitis
(74) *Attorney, Agent, or Firm* — Michael H. Jester

(57) ABSTRACT

A sprinkler includes a riser having an inlet end and an outlet end and a nozzle rotatably supported at the outlet end of the riser. The nozzle has a plurality of circumferentially spaced, radially extending stream forming channels. A gear drive is coupled for rotating the nozzle. A stationary arc plate has an upper surface adjacent a lower surface of the nozzle and includes a first aperture that directs water into terminal ends of the stream forming channels. A manually adjustable orifice plate is mounted in overlapping relationship with the stationary orifice plate. The adjustable orifice plate has a second aperture shaped and aligned with the first aperture so that manual rotation of the adjustable orifice plate increases or decreases an arc of an arc shaped water distribution pattern. A ratchet mechanism including radially deflectable tabs releasably locks the position of the adjustable orifice plate.

21 Claims, 5 Drawing Sheets

ROTARY STREAM SPRINKLER WITH ADJUSTABLE ARC ORIFICE PLATE

FIELD OF THE INVENTION

The present invention relates to commercial and residential irrigation systems for watering turf and other landscaping, and more particularly, to sprinklers used with such systems.

BACKGROUND OF THE INVENTION

Modern residential and commercial irrigation systems include subterranean plastic branch pipes that each feed water to multiple sprinklers. Pressurized water is fed to the branch pipes via solenoid actuated values which are energized by an electronic irrigation controller. The controller executes a watering program including programmed run and cycle times for all of the sprinklers on each of the branch pipes, which are collectively referred to as a station.

The sprinklers that are used in residential and commercial irrigation systems fall into several basic categories. Spray-type sprinklers are used for close-in watering and project a fan-shaped pattern of water which is either full circle or some division thereof, e.g. ninety degrees. Adjustable arc spray nozzles have also been used for many years. Rotor-type sprinklers are used where large area coverage is desired and typically eject from a nozzle a single, relatively robust inclined stream of water as much as sixty feet or more. The nozzle is most often oscillated through an adjustable arc utilizing turbine, gear reduction and reversing mechanisms. Rotor-type sprinklers often have replaceable nozzles to vary the precipitation rate, i.e. gallons per minute (GPM), of the sprinkler. Some rotor-type sprinklers used on golf courses have built-in valves. Rotary stream sprinklers simultaneously eject a plurality of smaller inclined streams of water. They are useful in applications where more coverage is needed than can be provided by a spray-type sprinkler, and usually less than that provided by a large rotor-type sprinkler. They also eject an aesthetically pleasing array of slowly moving water streams. One type of a modern rotary stream sprinkler has a pop-up riser with an inverted frusto-conical distributor head. Water is channeled upwardly through a flow-adjustable aperture and impinges on the underside of the distributor head. The distributor head has spiral grooves that form the rotary streams. A viscous damper or a brake mechanism ensures that the distributor head turns slowly so that the reach of the multiple streams is not unduly reduced. The shape of the aperture can be varied to adjust the pattern of coverage of the rotary streams. Some rotary stream sprinklers utilize a turbine driven gear train reduction that slowly rotates the distributor head.

SUMMARY OF THE INVENTION

In accordance with the present invention a sprinkler includes a riser having an inlet end and an outlet end and a nozzle rotatably supported at the outlet end of the riser. The nozzle has a plurality of circumferentially spaced, radially extending stream forming channels. A gear drive is coupled for rotating the nozzle. A stationary orifice plate has an upper surface adjacent a lower surface of the nozzle and includes a first aperture that directs water into terminal ends of the stream forming channels. A manually adjustable orifice plate is mounted in overlapping relationship with the stationary orifice plate. The adjustable orifice plate has a second aperture shaped and aligned with the first aperture so that manual rotation of the adjustable orifice plate increases or decreases an arc of an arc shaped water distribution pattern. The adjustable orifice plate includes an upper portion that extends through the first aperture of the stationary arc plate and has an upper surface adjacent a lower surface of the nozzle where the upper surface is wider than the stream forming channels of the nozzle. A ratchet mechanism including radially deflectable tabs releasably locks the position of the adjustable orifice plate.

DETAILED DESCRIPTION

Irrigation sprinklers with fixed arc patterns often water areas that do not require the water because landscapes are not always perfectly designed to match the fixed arc patterns provided by the manufacturers. It would be desirable to provide an improved gear driven rotary stream sprinkler that can uniformly water a relatively large area with an adjustable arc of coverage so that a precise area of landscape to be irrigated is achievable. Such a rotary stream sprinkler could also be used in place of multiple spray-type sprinklers and small rotor-type sprinklers and multiple valves. Such a sprinkler should have the capability for precisely tailoring its water distribution pattern including its shape and size.

The entire disclosure of U.S. Pat. No. 7,322,533 of Glendale Grizzle granted Jan. 29, 2008 and entitled "Rotary Stream Sprinkler with Adjustable Deflector Ring" is hereby incorporated by reference. That patent is assigned to Hunter Industries, Inc., the assignee of the subject application.

Figure 1:
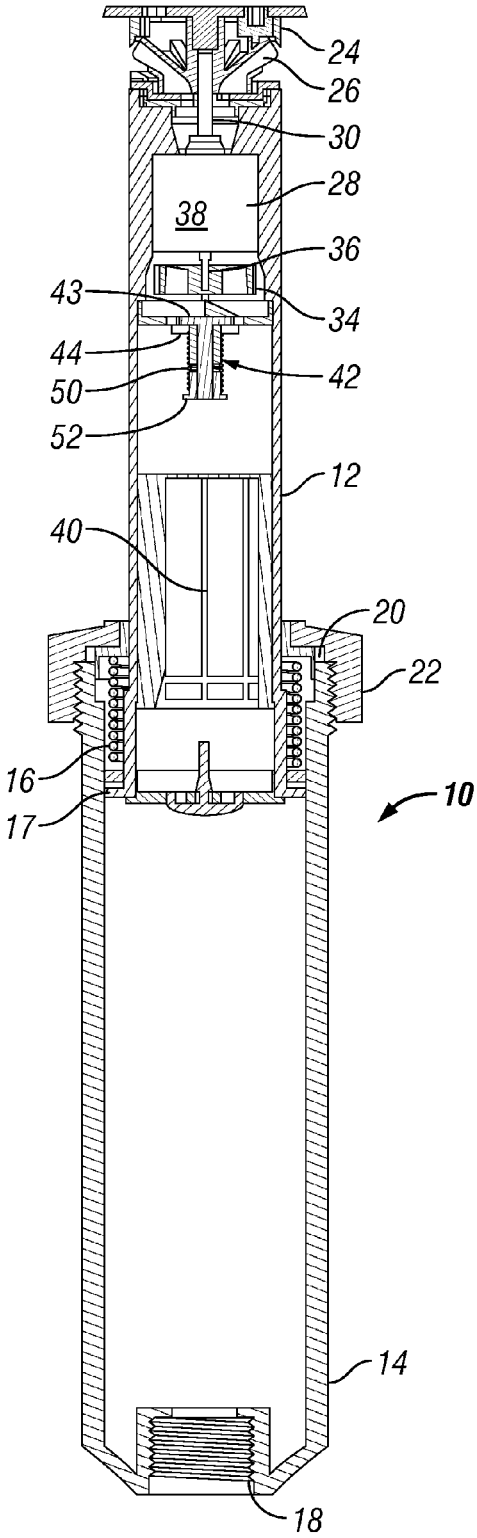
FIG. 1 is a vertical sectional view of a pop-up rotary stream sprinkler in accordance with an embodiment of the present invention. The sprinkler riser is illustrated in its extended position.
Figure 2:
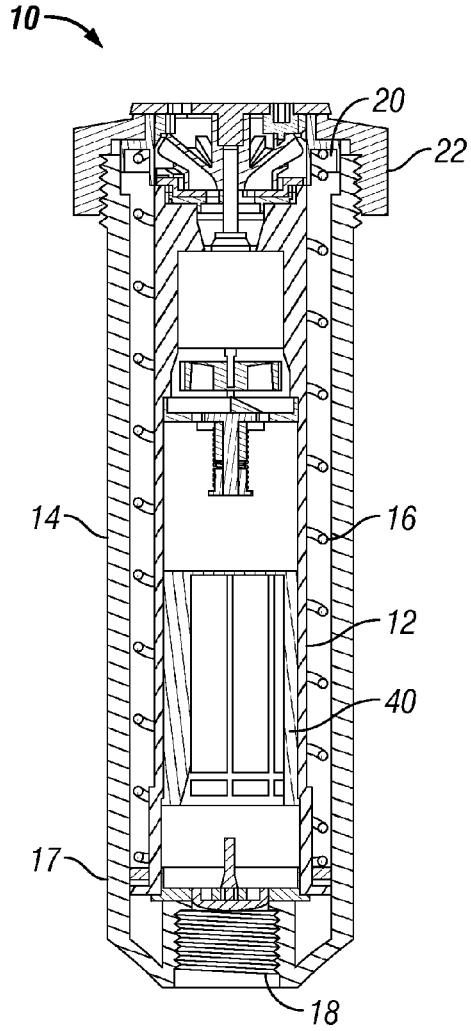
FIG. 2 is a view similar to FIG. 1 with the riser in its retracted position.

Unless otherwise indicated, the sprinkler hereafter described is made of molded plastic parts. Referring to FIGS. 1 and 2, an embodiment of a pop-up rotary stream sprinkler 10 includes a tubular riser 12 having an upper outlet end and a lower inlet end. A cylindrical outer body 14 surrounds and telescopically receives the riser 12. A large steel coil spring 16 surrounds the riser 12 and is compressed within the outer body 14 between a lower riser flange 17 and an upper elastomeric seal 20. The coil spring 16 is held in place by a threaded cap 22 screwed over a male threaded segment at the upper end of the outer body 14. The coil spring 16 biases the riser 12 to a retracted position illustrated in FIG. 2 within the outer body 14. The riser moves up to its extended position illustrated in FIG. 1 when pressurized water is supplied through the inlet 18 of the outer body 14.

Figure 3:
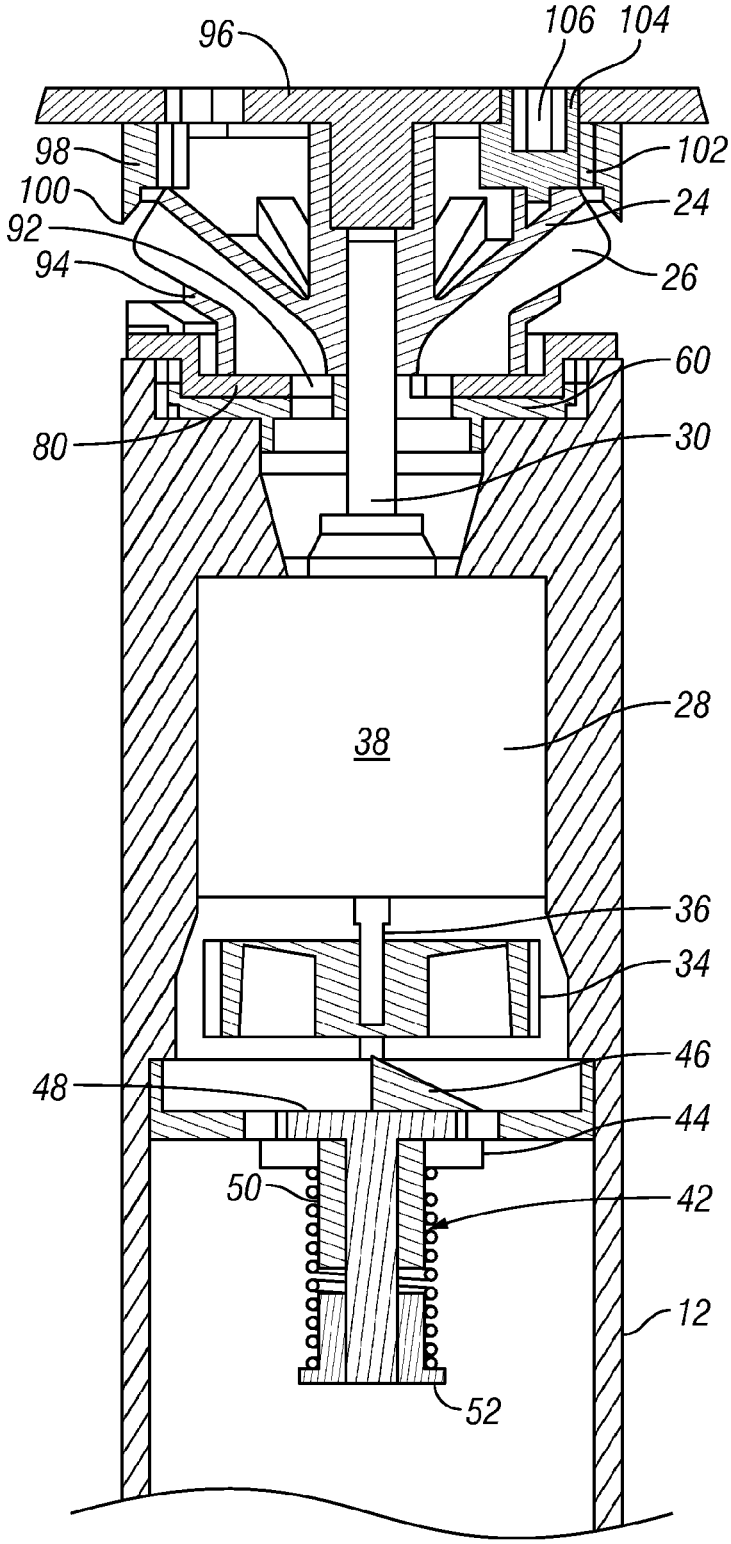
FIG. 3 is an enlarged portion of FIG. 1 showing details of the nozzle, drive assembly, impeller and speed regulator mounted in the riser of the sprinkler of FIG. 1.

A nozzle 24 (FIGS. 1 and 3) is rotatably mounted at the upper outlet end of the riser 12 for rotation about a vertical central axis Z. The nozzle 24 has six equally circumferentially spaced, radially extending stream forming channels 26. The stream forming channels 26 have curved upper walls and are generally upwardly inclined. A drive assembly 28 is mounted in the riser 12 and has a threaded steel output shaft 30 that screws into nozzle 24. An impeller 34 with spiral shaped vanes is coupled to a steel input shaft 36 of the drive assembly 28. The drive assembly 28 includes a gear train reduction (not illustrated) sealed within a cylindrical outer gear box or housing 38 that has an outer diameter smaller than the inner diameter of the riser 12. Water flowing through the inlet 18 passes through a filter screen 40 (FIG. 1) mounted in the lower inlet end of the riser 12 and then through a speed regulator 42 that maintains a speed of rotation of the nozzle 24 substantially constant regardless of variations in water flow. The speed regulator 42 is constructed in the form of a spring biased throttling valve. Water leaving a plurality of directed ports 46 impinges against the periphery of the impeller 34 to turn the gears in the drive assembly 24 before passing through an annular gap between the housing 38 and the inner wall of the riser 12. The speed regulator 42 includes a throttling valve member 48 (FIG. 3) that reciprocates up and down to progressively open a port in the stator housing 44 as more flow is required. The speed control valve 48 is biased to its retracted closed position by a small metal coil spring 50 whose lower end is captured by a spring retainer 52 coupled to the central shaft 54 of the speed control valve 48.

Figure 4:
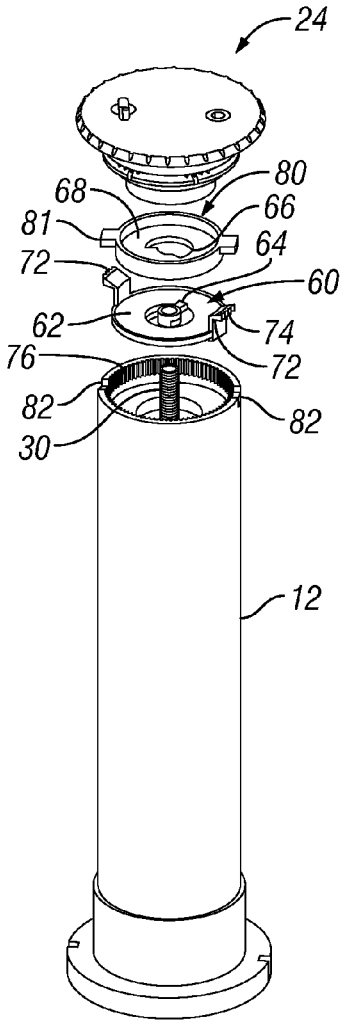
FIG. 4 is an exploded side elevation view taken from above the riser of the sprinkler of FIG. 1 illustrating its stationary orifice plate, adjustable orifice plate and nozzle assembly.
Figure 5:
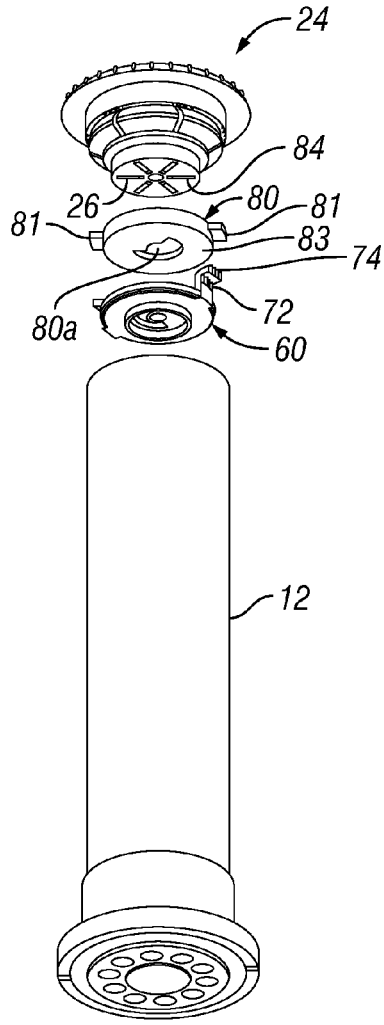
FIG. 5 is a view of the riser and its components similar to FIG. 4 taken from below.
Figure 6:
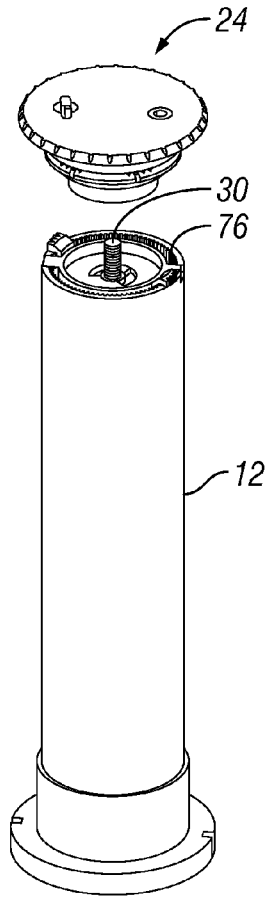
FIG. 6 is a view of the riser and its components similar to FIG. 4 illustrating the stationary orifice plate and adjustable orifice plate assembled in the riser and the nozzle assembly disconnected from the other components mounted in the riser.

Referring to FIGS. 4, 5, and 6 a lower cylindrical adjustable orifice plate 60 is installed adjacent the outlet end of the riser 12. The adjustable orifice plate 60 has an arcuate aperture 61 (FIG. 8C) formed in the center of a circular planar portion 62 thereof. The adjustable orifice plate 60 includes diametrically positioned adjusting tabs 72 with arc setting teeth 74. Non-rotating teeth 76 are formed on the upper inside surface of riser 12. When the adjustable orifice plate 60 is inserted in to the top or riser 12, the arc setting teeth 74 are engaged with the non-rotating teeth 76 to keep the arc adjustable orifice plate 60 from rotating during normal operation. The rotational position of the adjustable orifice plate 60 can be manually adjusted by manually pinching in on the adjusting tabs 72 to disengage the arc setting teeth 74 from the non-rotating teeth 76. Together the teeth 74 and 76 provide a ratchet mechanism for locking the rotational position and thus the pre-selected arc of coverage of the sprinkler 10. An upper stationary orifice plate 80 is installed on top of the adjustable orifice plate 60 and the radially protruding tabs 81 lock into the recesses 82 formed in the upper end of the riser 12 to keep the stationary arc plate 80 from rotating. The lower surface 83 of the stationary orifice plate 80 overlaps and engages the upper surface of the circular planar portion 62 of the adjustable orifice plate 60. When assembled, the arc limiting stop 64 protrudes through a central arcuate aperture 80*a* in the stationary orifice plate 80. The top surface of the arc limit stop 64 is flush with the upper surface 68 of the stationary orifice plate 80. This relationship is best seen in FIG. 6.

The nozzle 24 (FIGS. 3 and 5) has six equally circumferentially spaced, radially extending stream forming channels 26. The lower most portions of these channels terminate and open at flat lower surface 84. When the nozzle 24 is assembled to the output of the dear drive 38, the lower surface 84 of the nozzle 24 is in contact with the upper surface of the arc limiting stop 64 and the upper surface 68 of the stationary orifice plate 80. The orifice plates 60 and 80 are each replaceable by completely unscrewing the nozzle 24. The specific plastic materials from which these parts are molded are selected to create slick bearing surfaces whether wet or dry to allow the nozzle 24 to be rotated under normal operation by the gear drive 38. The close physical contact of these surfaces insures that the water is distributed only in the areas desired by the adjustment of the adjustable orifice plate 60. The width of the arc limiting stop 64 is greater than the width of the channels 26. As the lower surface 84 of nozzle 24 rotates over the upper surface of the arc limiting stop 64, water is sealed from going into the void 90 (FIGS. 10A & 10B) because the arc limiting stop 64 is wider than the channels 26, thus water will not fill the void 90 when one of the slots 26 is aligned directly over the arc limiting stop 64. If pressurized water were to fill the void 90, that water would be forced through the channels 26 of the nozzle when over that area and water would be put onto the landscape in areas that are not desired. The arc adjusting tabs 72 may be pressed radially inward by operator's fingers to release the fit between the adjustable orifice plate 60 and the teeth 76 formed on the inner surface of riser 12. When the tabs 72 are pressed inwardly, the adjustable orifice plate 60 may be rotated to a new position to increase or decrease the arc of the wetted area.

Figure 7A:
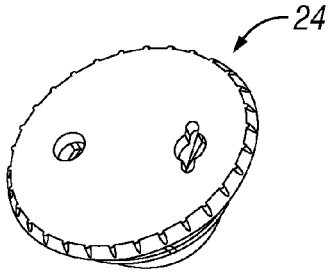
FIGS. 7A, 7B, and 7C are enlarged top isometric, bottom isometric, and bottom plan views, respectively, of the nozzle of the sprinkler of FIG. 1.
Figure 7B:
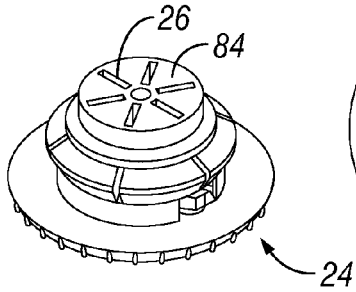
Figure 7C:
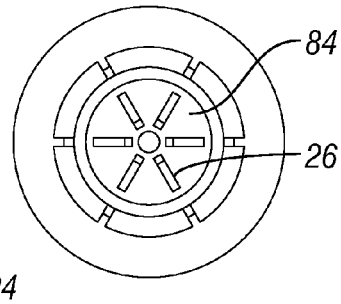
Figure 8A:
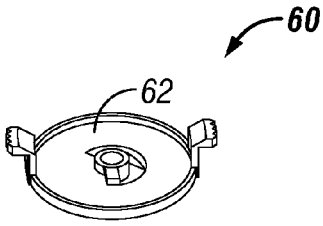
FIGS. 8A, 8B, and 8C are enlarged top isometric, bottom isometric, and bottom plan views, respectively, of the adjustable orifice plate of the sprinkler of FIG. 1.
Figure 8B:
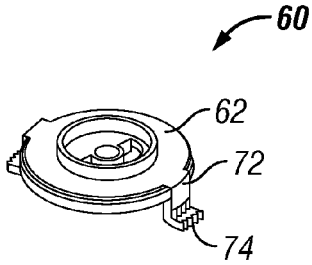
Figure 8C:
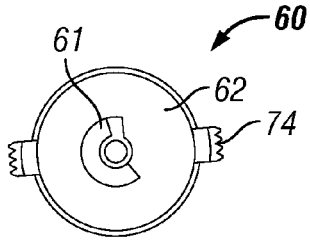
Figure 9A:
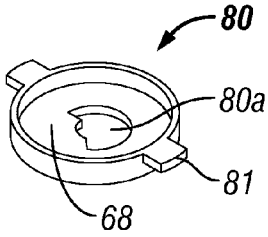
FIGS. 9A, 9B, and 9C are enlarged top isometric, bottom isometric, and bottom plan views, respectively, of the stationary orifice plate of the sprinkler of FIG. 1
Figure 9B:
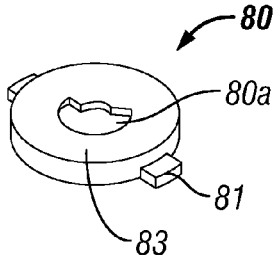
Figure 9C:
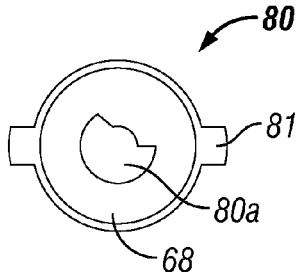

FIGS. 7A, 7B, and 7C are enlarged top isometric, bottom isometric, and bottom plan views, respectively, of the nozzle 24 of the sprinkler 10. FIGS. 8A, 8B, and 8C are enlarged top isometric, bottom isometric, and bottom plan views, respectively, of the adjustable orifice plate 60 of the sprinkler 10. FIGS. 9A, 9B, and 9C are enlarged top isometric, bottom isometric, and bottom plan views, respectively, of the stationary orifice plate 80 of the sprinkler 10.

Figure 10A:
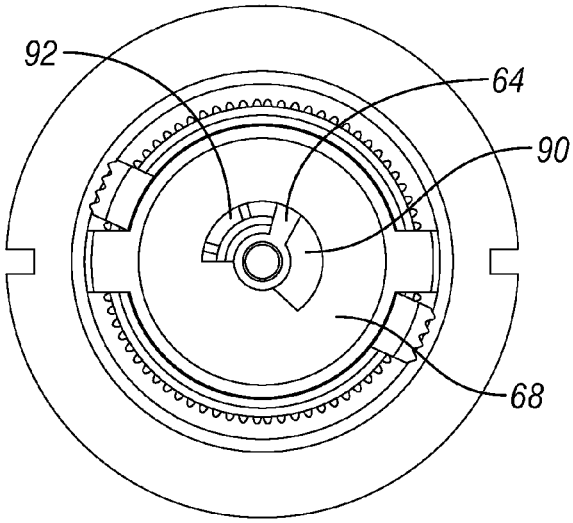
FIGS. 10A, 10B, and 10C are greatly enlarged top plan views of the stationary and adjustable orifice plates mounted in the sprinkler of FIG. 1 illustrating arc wetting patterns of approximately one-hundred, one hundred and sixty, and two hundred and ten degree settings, respectively.
Figure 10B:
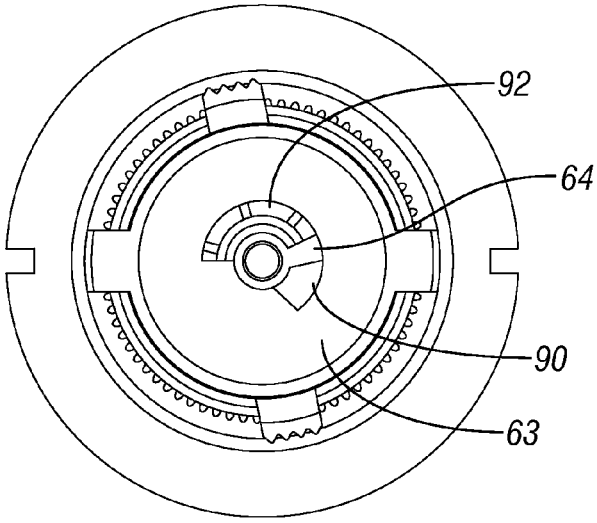
Figure 10C:
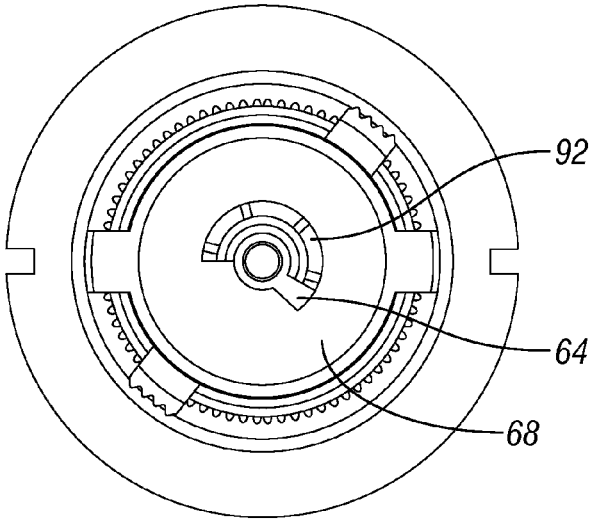

FIGS. 10A-C illustrate three different arc settings of the adjustable orifice plate 60. In each of these figures, area 92 is the aperture that allows water to come through the adjustable orifice plate assembly. This water is directed toward the channels 26 of the nozzle 24. Area 90 is a void created as the adjustable orifice plate 60 is rotated clockwise to reduce the arc of the wetted area. Area 90 is not illustrated in FIG. 10C because this figure illustrates the maximum arc setting where the void 90 is eliminated. The illustrated embodiment of the adjustable arc mechanism can adjust the arc of coverage of a wetted area between about ninety degrees and about two hundred and ten degrees. The orifice plates 60 and 80 can be removed and replaced with adjustable arc orifice plates that can be manually adjusted to provide different range of arcs, or stationary arc plates that wet a predetermined area. The size and arc of the apertures 61 and 80*a* can be varied to determine the maximum and minimum sizes of the arcuate water distribution pattern that can be formed by rotation of the adjustable orifice plate 60 relative to the stationary orifice plate 80.

The nozzle 24 (FIG. 3) includes a nozzle body 93 sandwiched between a lower nozzle collar 94 and an upper nozzle top 96. A rotatably adjustable cylindrical deflector ring 98 is mounted on, and surrounds, the nozzle body 93. The deflector ring 98 has a plurality of downwardly extending tooth-like projections 100 for intercepting streams of water ejected from the stream forming channels 26 to vary a radius or reach thereof. The deflector ring 98 preferably has six equally circumferentially spaced sets of projections 100. Each set of projections 100 corresponds to one of the stream forming channels 26. Each set of projections 100 includes a plurality of inverted V-shaped projections having progressive vertical lengths (along the Z axis). The spacing, length, shape and number of projections 100 in each set can be varied to achieve the desired adjustability of the throw of the water streams. The details of the adjustable deflector ring are disclosed in the aforementioned U.S. Pat. No. 7,322,533 of Glendale Grizzle. A ring gear 102 is formed on an interior surface of the deflector ring 100. A pinion gear 104 is rotatably supported in a socket formed in the nozzle top 96 and is engaged with the ring gear 102. The pinion gear 104 has a hexagonal-shaped socket 106 that can be engaged by a standard HUNTER® arc adjustment tool to incrementally rotate the deflector ring 98 to move various ones of its projections 100 into intercepting relationship with the stream of water being ejected from the corresponding stream forming slots 26. The further down the projections 100 extend into the water streams, the shorter their reach or throw will become. When multiple projections 100 of varying lengths intercept the same stream of water the stream is diffused in such a manner as to ensure close-in and medium range coverage.

A ratchet mechanism at the lower end of the riser 12 allows the riser 12 to be rotated relative to the outer body 14 to adjust the direction of ejection of the water streams in the case where less than all six of the stream forming channels 26 simultaneously eject water. The ratchet mechanism may comprise a plurality of radially extending vanes on the outer diameter of riser flange 17 (FIGS. 1 and 2) that deflect past radially inwardly directed teeth molded into the interior surface of the outer body 14.

While I have described an embodiment of a rotary stream sprinkler with an adjustable arc orifice, it will be apparent to those skilled in the art that my invention can be further modified in both arrangement and detail. For example, the functions and/or locations of the stationary and adjustable arc plates could be reversed in order of assembly. The number and shape of the stream forming channels could be varied. The pop up feature of the riser could be eliminated and the riser could be designed to attach directly to a pipe, or even a portable base, to be used with a garden hose. The configurations of the openings in the stationary and adjustable orifice disc may be modified to allow for more or less area of arc coverage. Other mechanisms for locking the selected position of the adjustable orifice plate 60 in position to set the arc could be used besides the illustrated ratchet mechanism. One example is friction between the overlapping surfaces of the adjustable orifice plate 60 and the stationary orifice plate 80. Therefore, the protection afforded my invention should only be limited in accordance with the scope of the following claims.

We claim:

1. A sprinkler, comprising:

a riser having an inlet end and an outlet end;

a nozzle having a plurality of circumferentially spaced, radially extending stream forming channels;

a drive assembly mounted in the riser having an output shaft rotatably supporting the nozzle at the outlet end of the riser;

an impeller coupled to an input shaft of the drive assembly;

a rotatable manually adjustable orifice plate adjustable by rotation, the adjustable orifice plate located adjacent the outlet end of the riser and having an aperture shaped to deliver water flowing through the riser into the stream forming channels in a manner that produces an adjustable arc of coverage for water distribution onto the landscape;

a stationary orifice plate adjacent to the manually adjustable orifice plate and having at least one radially extending tab that locks into the riser;

cape;

a stationary orifice plate adjacent to the manually adjustable orifice plate and having at least one radially extending tab that locks into the riser;

the adjustable orifice plate including at least one arc setting tab that engages with the riser to prevent rotation under normal operation, the at least one tab being deflected by an operator to disengage the tab from the riser to rotate the adjustable orifice plate to increase or decrease an arc of water distribution.

2. The sprinkler of claim 1 wherein the tab locks into at least one recess formed in the riser.

3. The sprinkler of claim 1 and further comprising an outer body surrounding and telescopically receiving the riser, and a coil spring surrounding the riser and biasing the riser to a retracted position within said body.

4. The sprinkler of claim 1 wherein the nozzle includes a nozzle body sandwiched between a nozzle collar and a nozzle top.

5. The sprinkler of claim 1 wherein the at least one adjustable tab includes a plurality of arc setting teeth that engage with a plurality of non-rotating teeth in the riser to prevent rotation under normal operation.

6. The sprinkler of claim 5 the at least one adjustable tab is a pair of diametrically positioned adjusting tabs that can be radially deflected by an operator to disengage the arc setting teeth from the non-rotating teeth and permit the operator to rotate the adjustable orifice plate to increase or decrease an arc of water distribution.

7. The sprinkler of claim 1 wherein the adjustable orifice plate includes a stop that extends through an aperture in the stationary orifice plate.

8. The sprinkler of claim 1 wherein a sealing surface of the adjustable orifice plate has a first width larger than a second width of the channels of the nozzle.

9. The sprinkler of claim 8 wherein the adjustable orifice plate is replaceable by completely unscrewing the nozzle.

10. A sprinkler, comprising:

a riser having an inlet end and an outlet end;

a nozzle rotatably supported at the outlet end of the riser and having a plurality of circumferentially spaced, radially extending stream forming channels;

a stationary orifice plate removably mounted adjacent to the outlet end of the riser having an aperture shaped to deliver water flowing through the riser into the stream forming channels in a manner that produces an arc shaped water distribution pattern;

a manually rotatably adjustable orifice plate configured and mounted for increasing or decreasing an arc of coverage of the sprinkler, the adjustable orifice plate including an arc limiting stop with a surface that contacts a lower surface of the nozzle and has a first circumferential width of the arc limiting stop that is larger than a second circumferential width of the channels of the nozzle.

11. The sprinkler of claim 10 and further comprising a drive assembly mounted in the riser and having an output shaft rotatably supporting the nozzle at the outlet end of the riser.

12. The sprinkler of claim 11 and further comprising an impeller coupled to an input shaft of the drive assembly.

13. The sprinkler of claim 12 and further comprising a speed regulator for maintaining a speed of rotation of the nozzle substantially constant regardless of variations in water pressure.

14. The sprinkler of claim 10 wherein the nozzle includes a nozzle body sandwiched between a nozzle collar and a nozzle top.

15. The sprinkler of claim 10 and further comprising a rotatably adjustable deflector ring having a plurality of projections for intercepting streams of water ejected from the stream forming channels to vary a reach thereof; and a ring gear formed on an interior surface of the deflector ring and a pinion gear rotatably supported by the nozzle and engaged with the ring gear, the pinion gear being rotatable by a tool to rotate the deflector ring.

16. The sprinkler of claim 15 wherein the deflector ring includes a plurality of sets of projections, each set corresponding to a stream forming slot, and each set including projections having progressive lengths.

17. The sprinkler of claim 10 wherein the stationary orifice plate contacts the bottom surface of the rotating nozzle to ensure that water passes only in the set arc of coverage.

18. A sprinkler, comprising:

a riser having an inlet end and an outlet end;

a nozzle having a plurality of circumferentially spaced, radially extending stream forming channels;

a drive assembly mounted in the riser having an output shaft rotatably supporting the nozzle at the at the outlet end of the riser;

an impeller coupled to an input shaft of the drive assembly;

an adjustable orifice plate mounted adjacent the outlet end of the riser having an aperture shaped to deliver water flowing through the riser into the stream forming channels in a manner that produces an arc of coverage that can increase of decrease the arc of a water distribution pattern; a stop connected to the orifice plate and having a first circumferential width that is greater than a second circumferential width of the channels in the nozzle, an upper surface of the stop contacting a bottom surface of the nozzle to maintain water within a predefined path;

a plurality of inwardly movable first tabs extending upwardly from the adjustable orifice plate and having teeth configured to engage teeth in the riser to prevent rotation under normal operating conditions;

and a stationary orifice plate having a plurality of second tabs that fit into recesses formed in corresponding recesses in an upper end of the riser to prevent rotation of the stationary orifice plate.

19. A sprinkler, comprising:

a riser having an inlet end and an outlet end;

a nozzle rotatably supported at the outlet end of the riser and having a plurality of circumferentially spaced, radially extending stream forming channels;

a gear drive coupled for rotating the nozzle;

a stationary arc plate having an upper surface adjacent a lower surface of the nozzle and including a first aperture that directs water into terminal ends of the stream forming channels;

a rotatable manually adjustable orifice plate adjustable by rotation mounted in overlapping relationship with the stationary orifice plate and having a second aperture shaped and aligned with the first aperture so that manual rotation of the adjustable orifice plate increases or decreases an arc of an arc shaped water distribution pattern;

a manually adjustable locking mechanism for releasably locking a rotational position of the adjustable orifice plate including at least one deflectable surface that engages with the riser to prevent rotation under normal operation and can be radially deflected by an operator to disengage the deflectable surface and permit the operator to rotate the adjustable orifice plate.

20. The sprinkler of claim 19 and further comprising an arc limiting stop that projects from the adjustable orifice plate through the first aperture to engage a lower surface of the nozzle and limit the water distribution pattern.

21. The sprinkler of claim 19 wherein the locking mechanism includes a pair of diametrically opposed adjusting tabs that can be manually pinched radially inward to disengage the tabs from the riser to allow the rotational position of the adjustable orifice plate to be adjusted.

* * * * *

UNITED STATES PATENT AND TRADEMARK OFFICE

CERTIFICATE OF CORRECTION

PATENT NO. : 8,297,533 B2
APPLICATION NO. : 12/577002
DATED : October 30, 2012
INVENTOR(S) : Richard M. Dunn and Glendale Grizzle It is certified that error appears in the above-identified patent and that said Letters Patent is hereby corrected as shown below:

In Claim 1, in column 6, delete lines 7 - 10.

In Claim 6, in column 6, in line 30, after "claim 5" insert -- wherein --.

Signed and Sealed this
Twenty-ninth Day of January, 2013

David J. Kappos

David J. Kappos
*Director of the United States Patent and Trademark Office*